US006756866B1

(12) United States Patent
Higgins

(10) Patent No.: US 6,756,866 B1
(45) Date of Patent: Jun. 29, 2004

(54) PHASE SHIFTING WAVEGUIDE WITH ALTERABLE IMPEDANCE WALLS AND MODULE UTILIZING THE WAVEGUIDES FOR BEAM PHASE SHIFTING AND STEERING

(75) Inventor: John A. Higgins, Westlake Village, CA (US)

(73) Assignee: Innovative Technology Licensing, LLC, Thousand Oaks, CA (US)

( * ) Notice: Subject to any disclaimer, the term of this patent is extended or adjusted under 35 U.S.C. 154(b) by 4 days.

(21) Appl. No.: 09/676,142

(22) Filed: Sep. 29, 2000

(51) Int. Cl.[7] ..... H01P 1/18
(52) U.S. Cl. ..... 333/157; 333/248
(58) Field of Search ..... 333/157, 248, 333/239

(56) References Cited

U.S. PATENT DOCUMENTS 5,526,172 A * 6/1996 Kanack ..... 359/291

OTHER PUBLICATIONS

D. Sievenpiper, *High Impedance Electromagnetic Surfaces*, (1999) PhD Thesis, University of California, Los Angeles.
Dorf, *The Electrical Engineering Handbook*, Second Edition, Section 37.2, p. 946 (1997).
IEEE Press, Paul F. Goldsmith, *Quasioptical Systems*, Chapter 1, and Chapter 2 (1999).
M. Kim et al., *A Rectangular TEM Waveguide with Photonic Crystal Walls for Excitation of Quasi–Optical Amplifiers*, (1999) MTI–S Archived on CD–ROM.

* cited by examiner

*Primary Examiner*—Benny Lee
(74) *Attorney, Agent, or Firm*—Koppel, Jacobs, Patrick & Heybl

(57) ABSTRACT

A waveguide is disclosed that shifts the phase of the signal passing through it. In one embodiment, the waveguide has an impedance structure on its walls that resonates at a frequency lower than the frequency of the signal passing through the waveguide. This causes the structure to present a capacitive impedance to the signal, increasing its propagation constant and shifting its phase. Another embodiment of the new waveguide has impedance structures on its wall that are voltage controlled to change the frequency at which the impedance structures resonate. The range of frequencies at which the structure can resonate is below the frequency of the signal passing through the waveguide. This allows the waveguide cause a adjust the shift in the phase of its signal. An amplifier array can be included in the waveguides to amplify the signal. A module can be constructed of the new waveguides and placed in the path of a millimeter beam. A portion of the beam passes through the waveguides and the beam can be shifted or steered depending on the phase shift through each waveguide.

5 Claims, 9 Drawing Sheets

PHASE SHIFTING WAVEGUIDE WITH ALTERABLE IMPEDANCE WALLS AND MODULE UTILIZING THE WAVEGUIDES FOR BEAM PHASE SHIFTING AND STEERING

BACKGROUND OF THE INVENTION

1. Field of the Invention

This invention relates to phase shifting and steering of high frequency electromagnetic signals.

2. Description of the Related Art

Electromagnetic signals are commonly guided from a radiating element to a destination via a coaxial cable, metal waveguide, or microstrip transmission line. As the frequency of the signal increases, these devices must have smaller cross-sections to transmit the signals. For example, a metal waveguide that is 58.420 cm wide and 29.210 high at its inside dimensions, transmits signals in the range of 0.32 to 0.49 GHz. A metal waveguide that is 0.711 cm wide and 0.356 cm high at its inside dimensions, transmits signals in the range of 26.40 to 40.00 GHz. {Dorf, *The Electrical Engineering Handbook, Second Edition, Section* 37.2, Page 946 (1997)}. As the signal frequencies continue to increase, a point is reached where use of these devices become impractical. They become too small and expensive, require precision machining to produce, and their insertion loss can become too great.

Frequencies exceeding approximately 100 GHz (referred to as millimeter waves) can be transmitted as a free-space beam. The signal from a radiating element is directed to a lens that focuses the signal into a millimeter wave beam having a diameter up to several centimeters. This form of transmission is referred to as "quasi-optic" when the lens diameter divided by the signal wavelength is in the range of approximately 1–10. In the optic regime, the lens diameter divided by the frequency wavelength is normally much greater than 10. {IEEE Press, Paul F. Goldsmith, *Quasi-optic Systems, Chapter* 1, Gaussian Beam Propagation and Applications (1999)}

One method of amplifying these high frequency beams is to combine the power output of many small amplifiers in a quasi-optic amplifier array. The amplifiers of the array are oriented in space such that the array can amplify a Gaussian beam of energy rather than amplifying a signal guided by a transmission line. However, commercial use of these "open" systems is not practical because they are fragile and can be contaminated by the surrounding environment. Also, there is no simple, durable and reliable mechanism for beam phase shifting or steering.

Conventional rectangular waveguides cannot be used. In addition to their size and insertion loss disadvantages they do not provide an optimal signal to drive an amplifier array. Because the sidewalls of a metal waveguide are conductive, they present a short circuit to the beam's E field and it cannot exist near the conductive sidewall. The power densities of the beam's E and H fields drop off closer to the sidewalls, with the power density of the beam varying from a maximum at the middle of the waveguide to zero at the sidewalls.

For an amplifier array to operate efficiently, each individual amplifier in the array must be driven by the same power level. When amplifying the type of signal provided by a conventional metal waveguide, the amplifiers at the center of the array will be overdriven before the edge amplifiers can be adequately driven. In addition, individual amplifiers in the array will see different source and load impedances depending upon their locations in the array. The array's edge amplifiers become ineffective, significantly reducing the array's potential output power.

A high impedance surface will appear as an open circuit and the E field will accordingly not experience the drop-off associated with a conductive surface. A photonic surface structure has been developed which exhibits a high impedance to a resonant frequency and a small bandwidth around that frequency {D. Sievenpiper, *High Impedance Electromagnetic Surfaces*, (1999) PhD Thesis, University of California, Los Angeles}. The surface structure comprises patches of conductive material mounted in a sheet of dielectric material, with conductive vias through the dielectric material from the patches to a continuous conductive layer on the opposite side of the dielectric material. This surface presents a high impedance to the resonant frequency and the gaps between the patches prevent surface current flow in any direction.

A second impedance structure has been developed that is particularly applicable to the sidewalls and/or top and bottom walls of metal rectangular waveguides. {M. Kim et al., *A Rectangular TEM Waveguide with Photonic Crystal Walls for Excitation of Quasi-Optic Amplifiers*, (1999) IEEE MTT-S, Archived on CDROM}. Either two or four of the waveguide's walls can have this structure, depending upon the polarizations of the signal being transmitted. The structure comprises parallel conductive strips on a substrate of dielectric material. It also includes conductive vias through the sheet to a conductive layer on the substrate's surface opposite the strips. At resonant frequency, this structure presents as a series of high impedance resonant L-C circuits.

When used on a rectangular waveguide's sidewalls, the structure provides a high impedance boundary condition for the resonant frequency's E field component for a vertically polarized signal, the E field being transverse to the conductive strips. The high impedance prevents the E field from dropping off near the waveguide's sidewalls, maintaining an E field of uniform density across the waveguide's cross-section. Current can flow down the waveguide's conductive top and bottom walls to support the signal's H field with uniform density. Accordingly, the signal maintains near uniform power density across the waveguide aperture.

When the high impedance structure is used on all four of the waveguide's walls, the waveguide can transmit independent cross-polarized signals with near-uniform power density. The structure on the waveguide's sidewalls presents a high impedance to the E field of the vertically polarized signal, while the structure on the waveguide's top and bottom walls presents a high impedance to the horizontally polarized signal. The structure also allows conduction through the strips to support the signal's H field component of both polarizations. Thus, a cross-polarized signal of uniform density can be transmitted.

Waveguides employing these high impedance structures are also able to transmit signals close to the resonant frequency that would otherwise be cut-off because of the waveguide's dimensions if all of the waveguide's walls were conductive. At the resonant frequency, the waveguide essentially has no cut-off frequency and can support uniform density signals when its width is reduced well below the width for which the frequency being transmitted would be cut-off in a metal waveguide.

SUMMARY OF THE INVENTION

The present invention provides a new rectangular waveguide that can shift the phase of the signal passing through it. The new waveguide has an impedance wall structure on at least two opposing walls that present a capacitive impedance to the E field of the signal passing through the waveguide. The capacitive impedance increases the signal's propagation constant and shifts its phase.

In one embodiment, the invention utilizes the impedance structures on two or all four of its walls. Instead of transmitting a signal at the wall structure's resonant frequency, the waveguide passes a signal with a frequency well above the structure's resonant frequency. This results in the structure presenting a capacitive impedance to the transverse E field of the waveguide's signal, instead of a very high impedance. The propagation constant of the signal increases and the waveguide becomes a "slow wave" structure, shifting the phase of the signal. The preferred impedance structure is the parallel conductive strip described above.

In another embodiment, the phase shifting waveguide again has an impedance structure on two or all four of its walls, with the impedance structure being voltage controlled to resonate at different frequencies. The range of resonant frequencies is below the signal frequency being passed by the waveguide, and changes in the structure's resonant frequency result in different shifts in the phase of the signal being passed. The preferred impedance structure has parallel conductive strips. To change the resonant frequency, the impedance structures include varactor diodes along the gaps between the structure's conductive strips. A change in the voltage applied to the varactor diodes changes both the capacitance across the gap and the resonant frequency of the structure.

Another embodiment of the new waveguide includes both a phase shifter and an amplifier array to amplify the phase shifted signal. For a vertically polarized signal, a multi-region impedance structure is initially provided on the waveguide's sidewalls. The first region is a conductive strip impedance structure that is resonant to the beam frequency at the front of the waveguide. Progressing further down the waveguide, the gap between the conductive strips narrows, reducing the structure's resonant frequency. Next the signal enters the phase shift region where the gap between the strips maintain a constant width. Between the gaps is a varactor structure that varies the capacitance across the gaps in response to voltage changes. As described above, this change in capacitance shifts the beam's phase. The signal then enters the second transition region where the gaps widen so that the structure resonates at the signal frequency. The signal then enters the amplifier region, which has a strip structure on all four walls that resonates at the signal frequency. This section provides a near uniform signal to the amplifier, and the amplified signal emits from th e waveguide.

The new waveguides can be used in a new millimeter beam module that is placed in a millimeter beams path to shift the beam's phase and/or steer the beam, as well as amplify the beam. The module includes a plurality of new waveguides adapted to receive at least part of the electromagnetic beam. The waveguides are adjacent to one another, with their longitudinal axes aligned with the propagation of the beam. In one embodiment, each waveguide can be set to cause the same phase shift in its portion of the beam, shifting the phase in the entire beam uniformly. Each waveguide can also cause a different phase shift to steer the beam, and can also include a amplifier array to amplify the beam.

To reduce beam degradation from reflection off the front edge of the module the waveguides in the module include a front end launching region in the form of a patch impedance structure that is resonant at the beam frequency. This makes the front edges of the waveguides invisible to the entering wavefront, allowing only the TEM mode of the signal to enter the waveguide and preventing signal reflection.

These and other further features and advantages of the invention will be apparent to those skilled in the art from the following detailed description, taken together with the accompanying drawings, in which:

DETAILED DESCRIPTION OF THE INVENTION

Waveguide Phase Shifter

Figure 1:
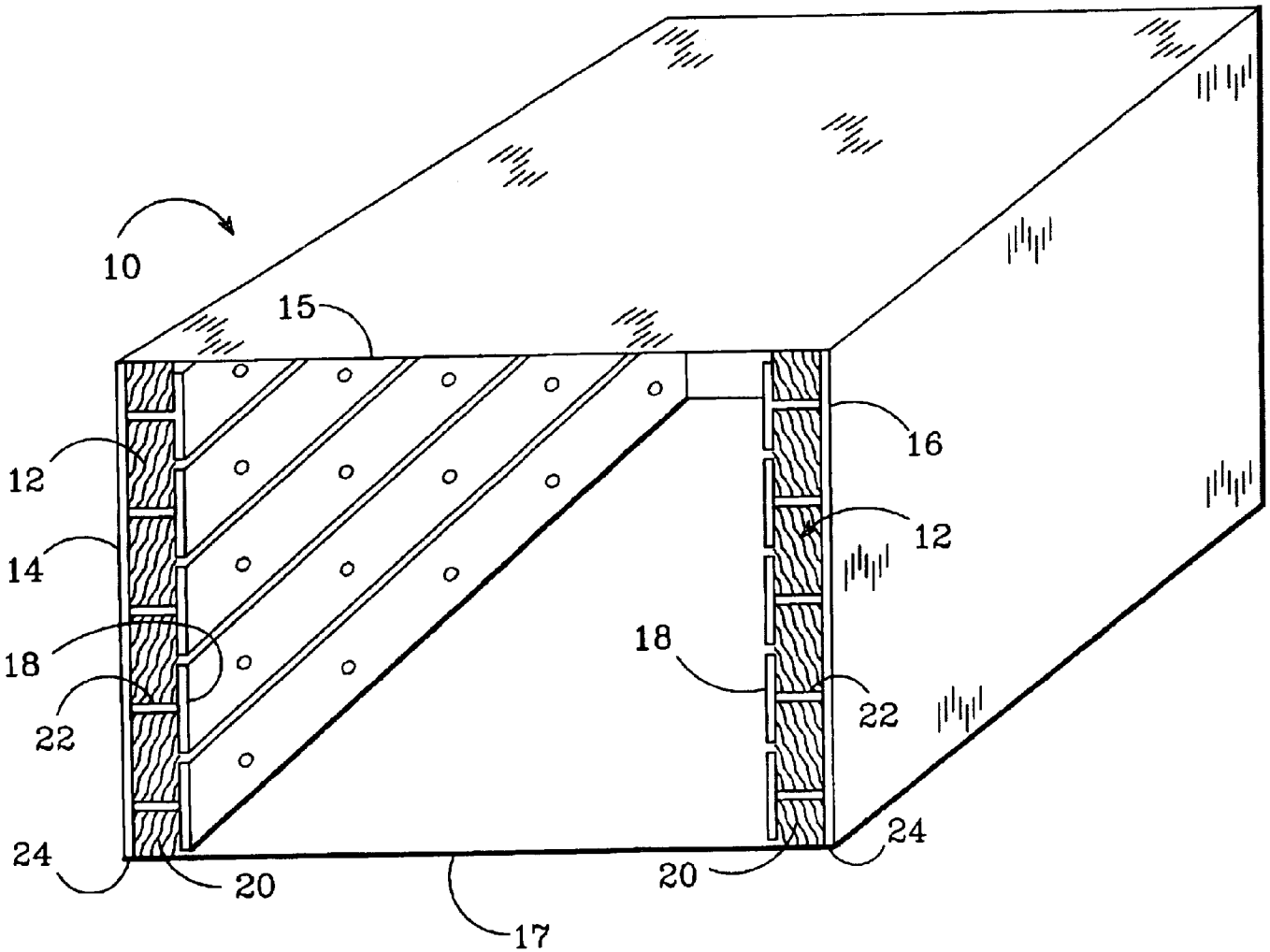
FIG. 1 is a perspective view of one embodiment of the new waveguide for shifting the phase of the signal passing through it.

FIG. 1 shows a new phase shifting waveguide 10 constructed in accordance with the present invention, which comprises a top wall 15, a bottom wall 17 and left and right sidewalls 14, 16. It further comprises strip impedance structures 12 on its left and right sidewalls 14, 16. Each impedance structure includes a plurality of conductive strips 18 parallel to the waveguide's longitudinal axis and facing its interior. The strips 18 are made of a conductive material and are provided on a substrate of dielectric material 20. Conductive sheets 24 are provided over the exterior of each dielectric substrate 20 with vias 22 included along each strip's longitudinal axis extending through the substrate to its respective sheet 24 to form a conductive path between the strips and the sheets.

Figure 2:
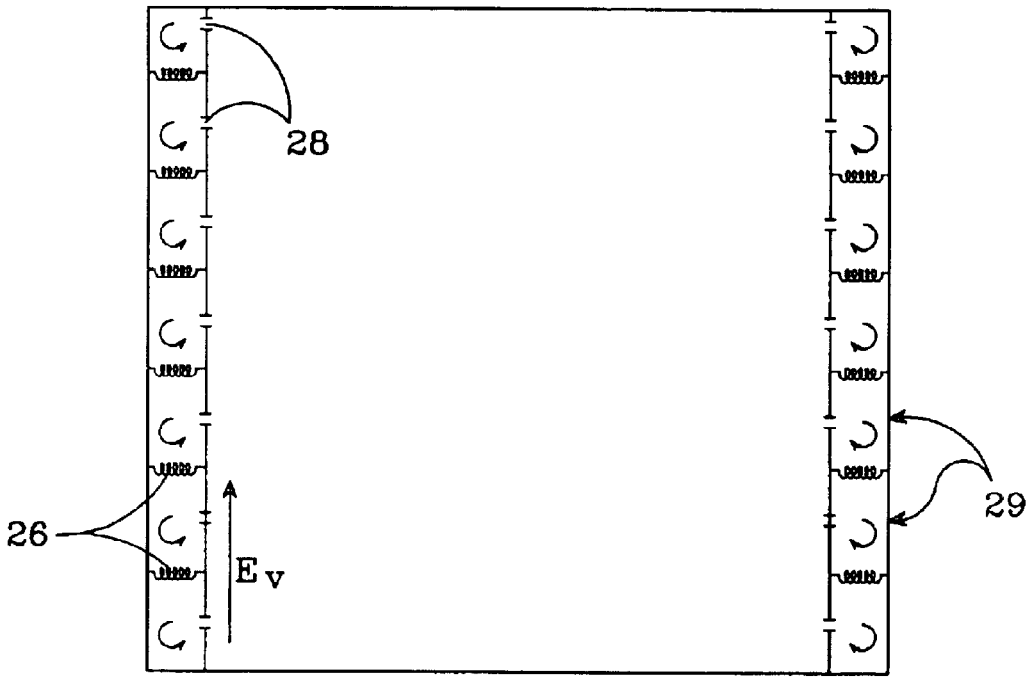
FIG. 2 is a diagram illustrating the waveguide's high inductance and capacitance presented to a transverse E field.

With the impedance structures 12 on its sidewalls, the waveguide 10 is particularly applicable to passing vertically polarized Ev signals that have an E field transverse to the strips 18. As shown in FIG. 2, at a particular resonant frequency the vias 22 present an inductive reactance (L) 26 to the transverse E field, and the gaps between the strips 18 present an approximately equal capacitive reactance (C) 28. The surface presents parallel resonant L-C, circuits 29 to the signal's transverse E field component; i.e. a high impedance.

Figure 3:
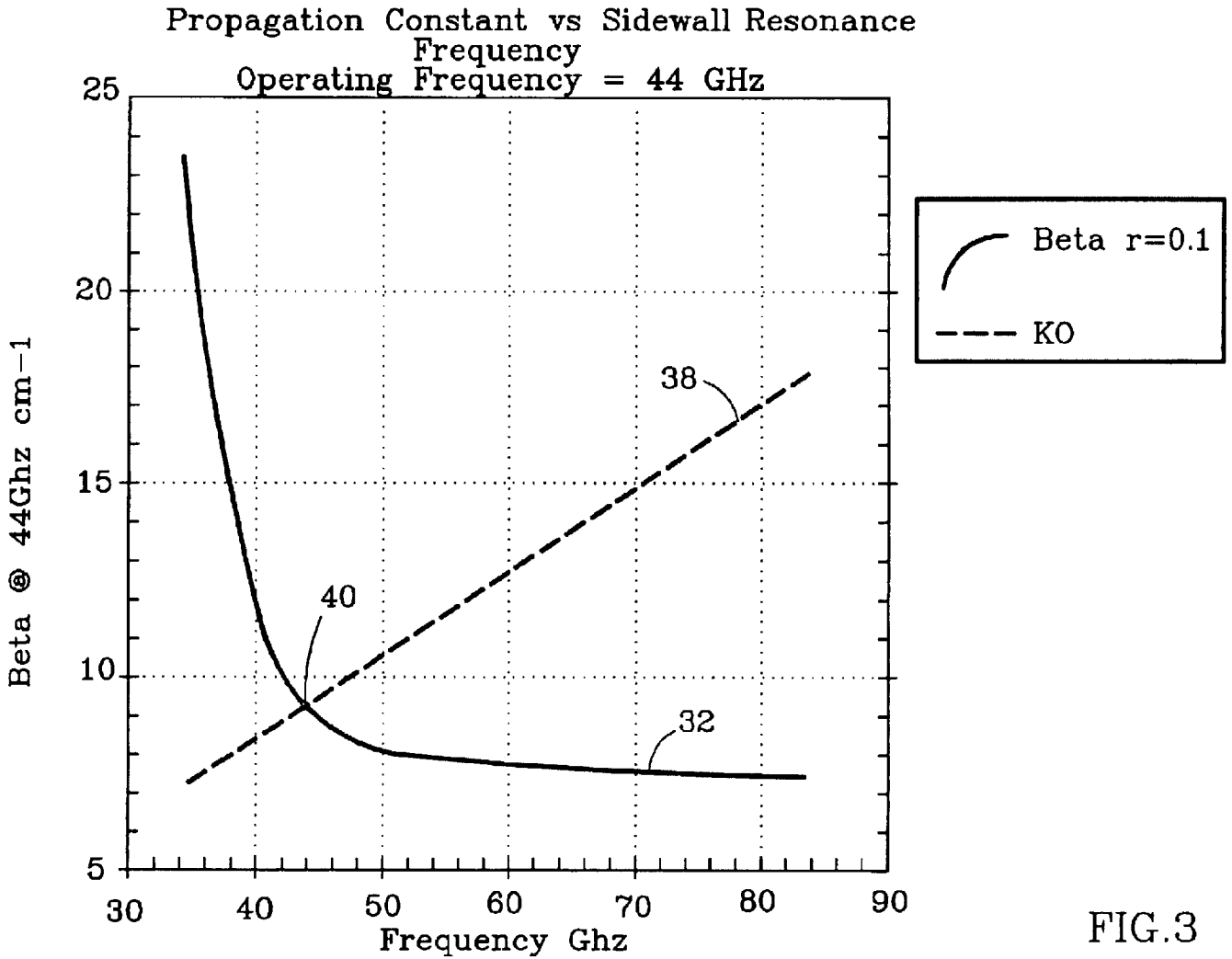
FIG. 3 is a graph showing the changes in a signal's propagation constant through a waveguide, in relation to changes in the waveguide's impedance structures.

The new waveguide is not designed to transmit signals with a frequency that causes the structure 12 to resonate. Instead, it functions as a phase shifter by passing signal well above the structures' resonant frequency. It relies on the unique relationship between the propagation constant of a particular frequency signal in a waveguide, and the frequency at which the impedance structures resonate. In FIG. 3 curve 32 illustrates the relationship between a signal's propagation constant (Beta) through a waveguide and the resonant frequency of the waveguide's high impedance structure. Line 38 shows Beta as a function of frequency for a signal propagating in free space, out side the waveguide.

In this example, the two curves intersect at 44 GHz (point 40 in the graph) Thus, forming the waveguide with a resonant frequency of 44 GHz will allow the waveguide to transmit a 44 GHz signal as if propagating in free space. Changes in the impedance structure's resonant frequency changes the signal's propagation constant. Due to the near-vertical slope of curve 32 at lower frequencies and its near-horizontal slope at higher frequencies, increasing the structure's resonant frequency results in only small changes in the signals propagation constant, while reducing the resonant frequency causes a significant change in the beam's propagation constant.

Accordingly, to shift the phase of the signal passing through the waveguide 10, the resonant frequency of the structure 12 is lower than the frequency of the signal passing through the waveguide. The structure presents a capacitive impedance to the signal's E field, increasing the signals propagation constant and shifting its resonant frequency. For example, if waveguide 10 is passing a 44 GHz signal and has a structure 12 on its sidewalls 14, 16 that is designed to resonate at 35 GHz, the 44 GHz signal passing through the waveguide will experience a phase shift.

Numerous materials can be used to construct the impedance structure 12. The dielectric substrate 20 can be made of many dielectric materials including, but not limited to, plastics, poly-vinyl carbonate (PVC), ceramics, or high resistance semiconductor material such as Gallium Arsenide (GaAs), all of which are commercially available. Highly conductive material should be used for the conductive strips 18, conductive layer 24 and vias 22.

One embodiment of the structure 12 that resonates in response to a 35 GHz signal, comprises a dielectric substrate 20 of gallium arsenide (GaAs) that is 10 mils thick. The conductive strips 18 can be 1–6 microns thick with the preferred strips being 2 microns thick. The conductive strips 18 are 16 mils wide with a 1.5 mil gap etched between adjacent strips. The conductive layer 24 on the opposite side of the dielectric substrate 20 can also be 1–6 microns thick. Both the conductive layer 24 and the conductive strips 18 are preferably gold. The dimensions of the structure can change depending on the resonant signal frequency and the materials used. Accordingly, the above example is included for illustration purposes only and should not be construed as a limitation to this invention.

The structure 12 is manufactured by first vaporizing a layer of conductive material on one side of the dielectric material using any one of various known methods such as vaporization plating. Parallel lines of the newly deposited conductive material are etched away using any number of etching processes, such as acid etching or ion mill etching. The etched lines (gaps) are of the same width and equidistant apart, resulting in parallel conductive strips 18 on the dielectric material 20, the strips 18 having uniform width and a uniform gap between adjacent strips.

Holes are created through the dielectric material at uniform intervals. The holes can be created by various methods, such as conventional wet or dry etching. The holes are then filled or covered with the conductive material and outer surface of the dielectric material is covered with the conductive layer 24, both preferably accomplished using sputtered vaporization plating. The holes do not need to be completely filled, but their walls must be covered with the conductive material. The completed holes provide conductive vias 22 between the conductive layer 24 and the conductive strips 18.

Waveguide with Variable Phase Shifting

Figure 4:
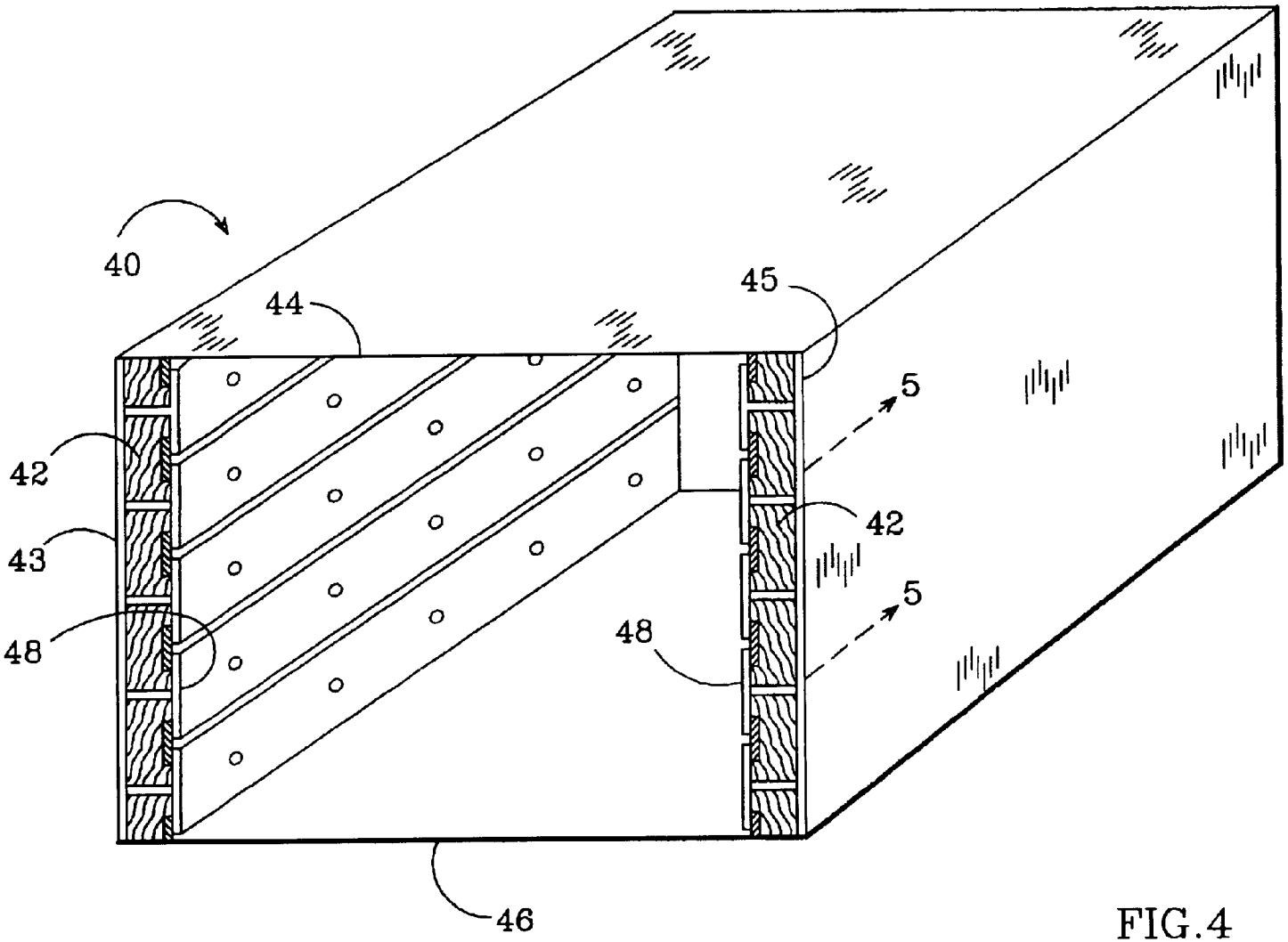
FIG. 4 is a perspective sectional view of another embodiment of the new waveguide that can cause different phase shifts in the signal passing through it.

A second embodiment of the new waveguide phase shifter 40 according to the present invention is shown in FIG. 4, and comprises a top wall 44, a bottom wall 46 and left and right sidewalls 43, 45. It further comprises the previously described impedance strip structures 42 on its sidewalls 43, 45, with the; strips 48 parallel to the waveguide's longitudinal axis. In this embodiment, the frequency at which the individual structures resonate can be varied within a range of resonant frequencies below the frequency of the signal the waveguide 40. Different resonant frequencies for the impedance structures result in different shifts in the phase of the signal passing through the waveguide. The resonant frequency of the impedance structure 42 is varied by varying the capacitance between the strips 48.

Figure 5:
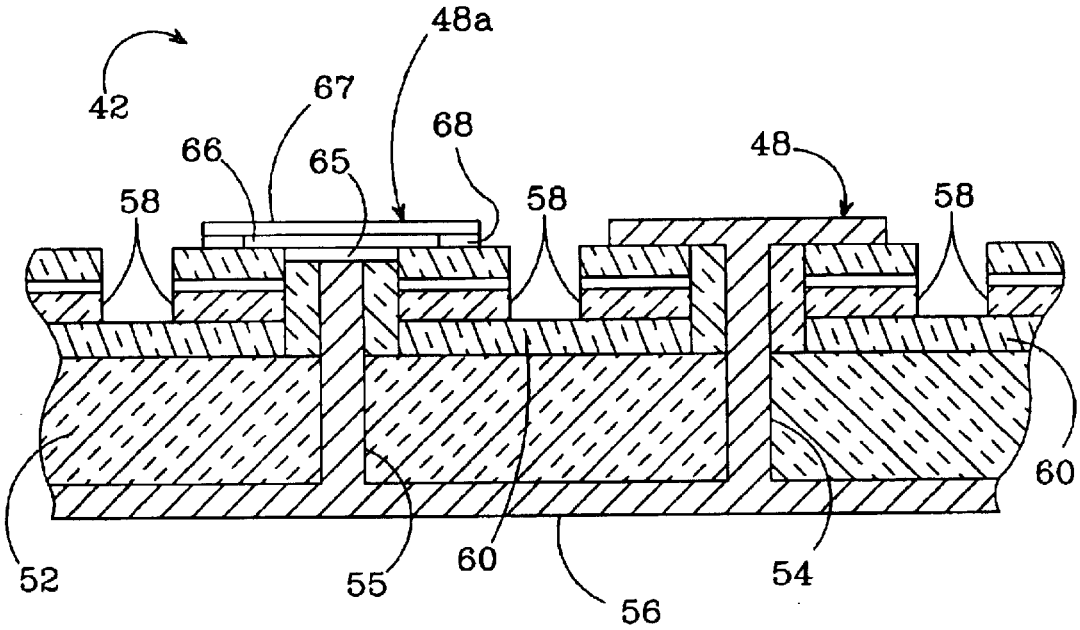
FIG. 5 is a sectional view of the high impedance structure used in the waveguide of FIG. 4, taken along section lines 5—5.

FIG. 5 is a detailed sectional view of one of the impedance structures 42. It has alternating conductive strips 48 similar to those described above. They have uniform width and are formed on a dielectric (e.g. high resistivity GaAs) substrate 52, that can be made of the same dielectric materials as the dielectric 20 in FIG. 1. Conductive vias 54 extend from the strips, through the substrate 52 to a conductive layer 56 on the substrate's outer surface. Control strips 48*a* are provided between the conductive strips 48 and have a voltage (TV) applied to them that controls the capacitance across the gaps between strips 48 and 48*a*. Each control strip 48*a* has vias 55 extending through the dielectric substrate 52 to the conductive layer 56. Each strip comprises a conductive via cap 65 on top of its vias 55, an insulator strip 66 on top of the via cap 65, and a wider conducting voltage strip 67 on the insulating strip 65. Each gap between strips 48 and 48*a* have a pair of varactor (i.e. variable capacitance) Amp diodes 58 to vary the capacitance across the gaps. Varactor diodes are junction diodes that are utilized for their voltage dependent capacitance. A conductive N+layer 60 connects each pair of varactor diodes 58 across each gap. Along the edge of each insulating strip 66, between the voltage strip 67 and the varactor diode below, is a conductive coupling strip 68 that provides a conductive path between the voltage strip 67 and the varactor diode 58.

In operation, a voltage is applied to each conducting voltage strip 67. The diodes across the gaps on either side of the strip 48*a* are connected through the N+layer 60. The ground for the voltage is provided strips 48 and the vias 55, to the conducting layer 56. The insulating layer 66 insulates the voltage strip 67 from the underlying via cap 65 to prevent strip from shorting to the via 55. A high voltage applied the voltage strips 67 reduces the capacitance of each diode 58 and reduces the capacitance across the gaps. The structure then resonates at a higher frequency. As the voltage is reduced, the capacitance across the gaps increases, decreasing the frequency at which the structure resonates. Increasing the voltage to a particular level can provide the desired shift in the beam's phase.

In fabricating the diodes 58, N+layers 60 of a semiconductor material such as GaAs, are etched into mesas before the strips 48 are formed. The layer 60 runs along the gaps between the strips and will be partially below the strips 48 and 48*a* on each side of the gaps. The diodes 58 are then formed on the N+layer 60, with both the N+layer 60 and the diodes terminating short of the vias 54 and 55 and separated therefrom by intervening portions of the dielectric material. When the strips 48, insulating layer 66, coupling strip 68 and voltage strip 67 are formed, they extend over a diode 58 on each lateral side.

Figure 6:
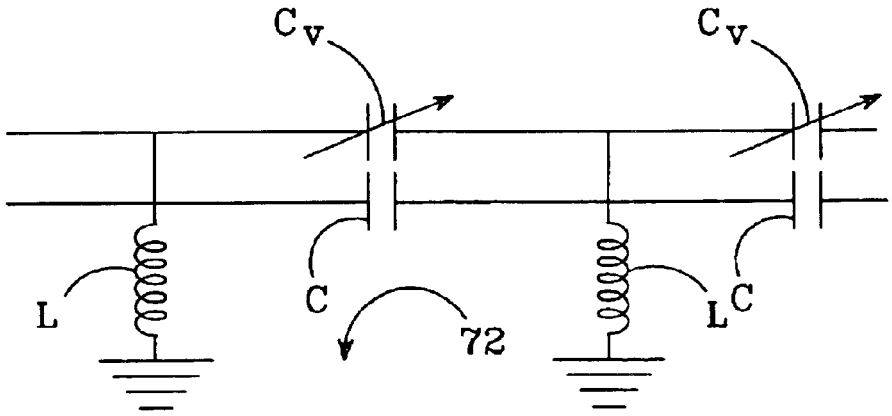
FIG. 6 is a diagram of equivalent L-C circuits formed by the impedance structure in FIG. 4.

As shown in FIG. 6, at a particular resonant frequency the vias 54 present an inductive reactance L to the transverse E field, and the gaps between the strips 48 and 48 *a* present an approximately equal capacitive reactance C. The varactor diodes 58 provide a variable capacitance $C_v$ that varies the capacitive reactance presented to the transverse E field. The impedance structure presents parallel resonant L-C circuits 72 to the signal's transverse E field component at different frequencies depending upon capacitance $C_v$.

In another embodiment of the new waveguide (not shown), all four walls of the waveguide 40 can have the, impedance structure. The waveguide can then be used to shift the phase of either a vertically or horizontally polarized signal, or both. For a vertically polarized signal the impedance structures on the waveguides sidewalls 43, 45 shift the signal's phase. For horizontally polarized signals the structures on the waveguide's top and bottom walls 44, 46 shift the signal's phase.

Waveguide with Phase Shifter and Amplifier Array

Figure 8:
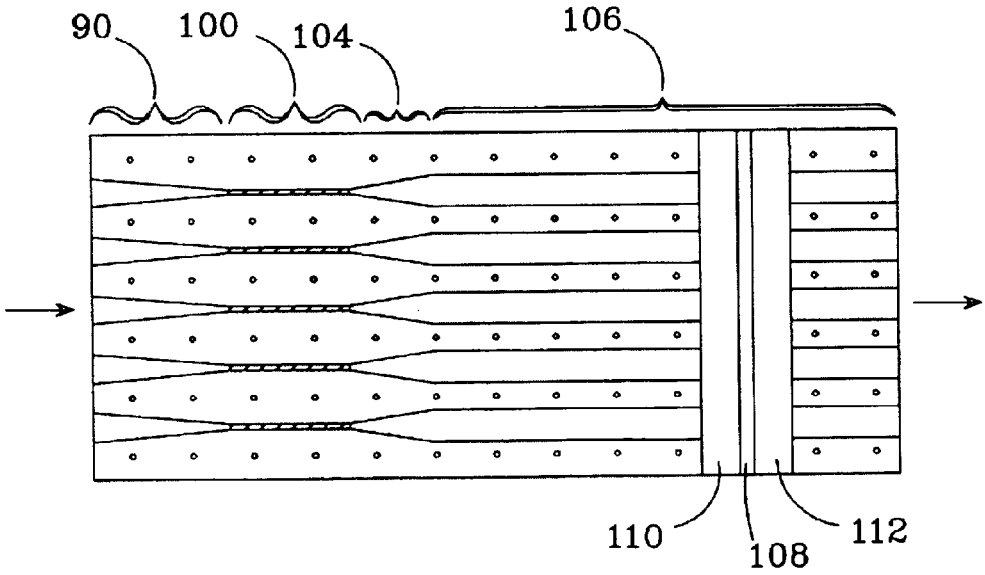
FIG. 8 is a sectional view of the shown in FIG. 7, taken along section lines 8—8.
Figure 7:
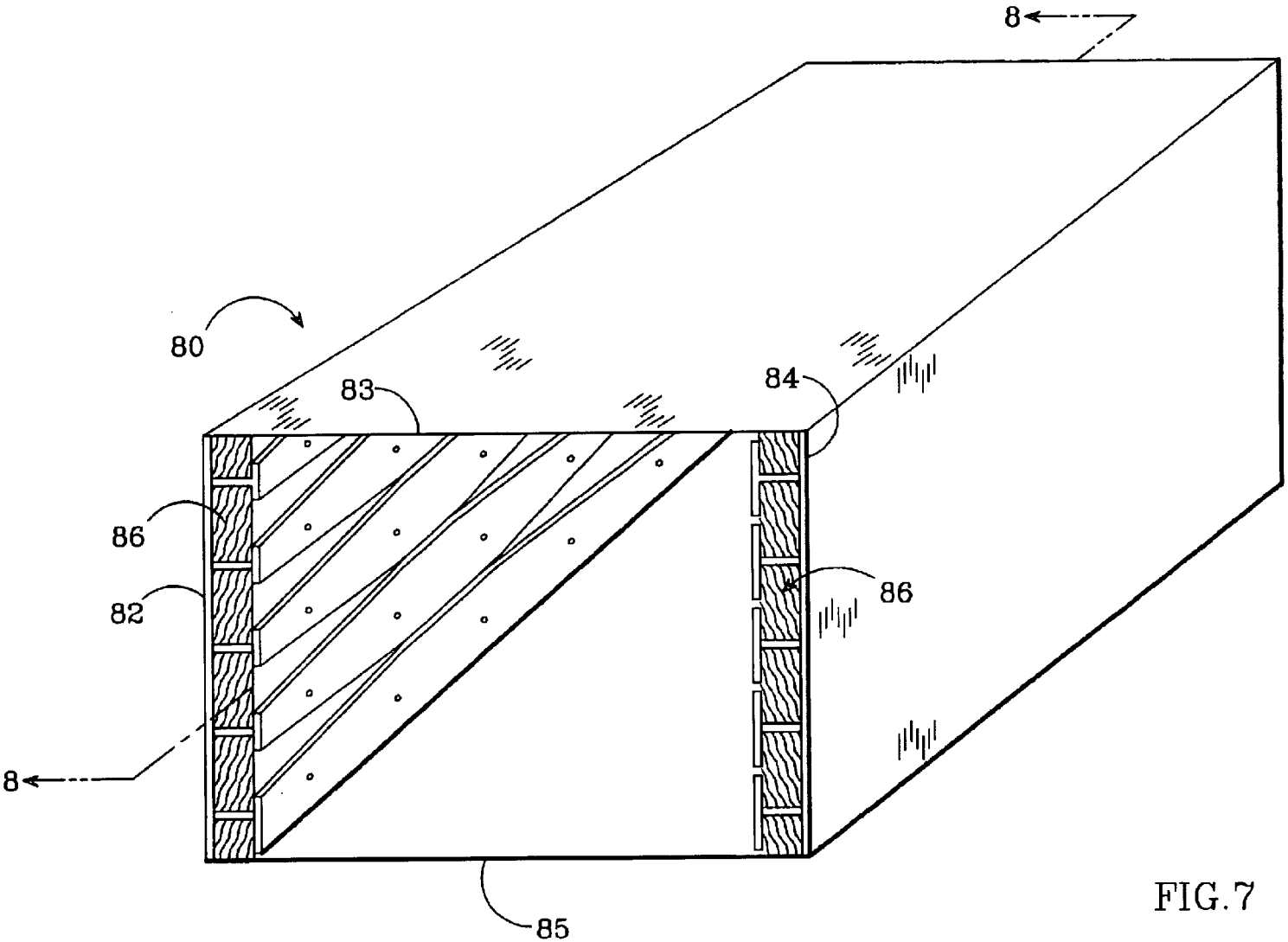
FIG. 7 is a perspective sectional view of a third embodiment of the new waveguide that can cause different phase shifts to and amplify a signal passing through it.

FIG. 7 shows another embodiment of the new waveguide 80 having a variable phase shifter and an amplifier array to amplify the phase shifted signal. The waveguide has sidewalls 82, 84 and top and bottom walls 83, 85, with the sidewalls including multi-stage high impedance structure 86, shown in more detail in FIG. 8.

Figure 9:
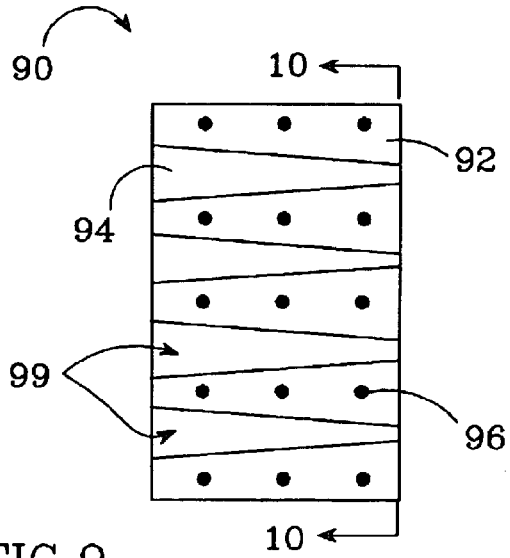
FIG. 9 is a plan view of the transition region of the structure shown in FIG. 8.
Figure 10:
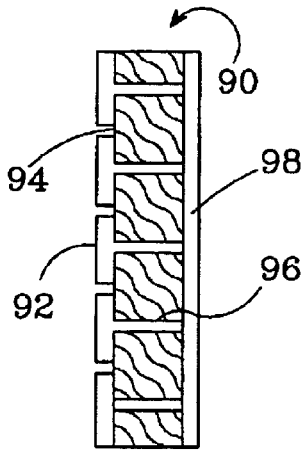
FIG. 10 is a sectional view of the transition region shown in FIG. 9, taken along section lines 9—9.

The signal entering the waveguide encounters a first transition region 90 which is shown in more detail in FIGS. 9 and 10. This region has strips of conductive material 92 on a dielectric substrate 94. Like the above embodiments, conductive vias 96 run from the strips 92 through the dielectric substrate 94 to a conductive layer 98 as best seen in FIG. 10. The structure is different from the above embodiments because the gaps 99 (see FIG. 9), between the strips are initially at a width that allows the structure to resonate at the frequency of the signal passing through the waveguide. The gaps 99 then narrow moving away from the front of the waveguide, reducing the resonant frequency.

As shown by the graph in FIG. 3, decreasing the impedance structure's resonant frequency places the waveguide in the portion of the curve 32 where additional changes in the resonant frequency result in larger changes in the beam's propagation constant.

The transition region is manufactured in a manner similar to the previous embodiments, except for etching the initially deposited conductive material to provide conductive strips with a narrowing gap between adjacent strips.

Referring back to FIG. 8, after the transition region 90, the beam enters a phase shift region 100 which produces the desired shift in the beam's phase by varying the gap capacitance. This section is similar to the impedance structure 42 described above and shown in FIGS. 4 and 5. It has parallel conductive strips and varactor diodes across the gaps between strips to vary the capacitance across the gaps, and thereby the frequency at which the structure 100 resonates. This change in resonant frequency shifts the signal's phase.

The beam then passes through a second transition region 104. This region is similar to the first transition region, but the gaps between the strips increase in the beam's direction. The frequency at which this structure resonates thus increases until at the end of the region it resonates at the beam frequency. At this location the beam has the desired phase shift and because the impedance structure is resonating, it also has uniform E and H fields.

The signal then enters the amplifier region 106. An array amplifier chip 108 is positioned within this section to amplify the signal from the second transition section 104. The amplifier region 106 has impedance structures mounted on all four waveguide walls to support both horizontal and vertical polarizations (cross polarized). A signal reaching the array amplifier chip 108 will have uniform E and H fields, and thus, equally drives each of chip's amplifiers. Array amplifier chips 108 are generally transmission devices rather than reflection devices, with the input signal entering one side and the amplified signal transmitted out the opposite side. This reduces spurious oscillations that can occur because of feedback or reflection of the amplified signal toward the source.

Array amplifiers chips also change the polarity of the signal 90° as it passes through as is amplified, further reducing spurious oscillations. However, a portion of the input signal carries through the array amplifier with the original input polarization. In addition, a portion of the output signal reflects back to the waveguide area before the amplifier. Thus, in amplifier section 106 both polarizations will exist.

The strip feature of the wall structures allows the amplifier section 106 to, support a signal with both vertical and horizontal polarizations. The wall structure presents a high impedance to the transverse E field of both polarizations, maintaining the E field density across the waveguide for both. The strips allow current to flow down the waveguide in both polarizations, maintaining a uniform H field density across the waveguide for both. Thus, the cross polarized signal will have uniform density across the waveguide.

Matching grid polarizers 110 and 112 are mounted on each side of and parallel to the array amplifier chip 108. The polarizers appear transparent to one signal polarization, while reflecting a signal with an orthogonal polarization. For example, the output grid polarizer 112 allows a signal with an output polarization to pass, while reflecting any signal with an input polarization. The input polarizer 110 allows a signal with an input polarization to pass, while reflecting any signal with an output polarization. The distance of the polarizers from the amplifier can be adjusted, allowing the polarizers to function as input and output tuners for the amplifier, with the polarizers providing the maximum benefit at a specific distance from the amplifier.

Shifting and Beam Steering Module

Figure 11:
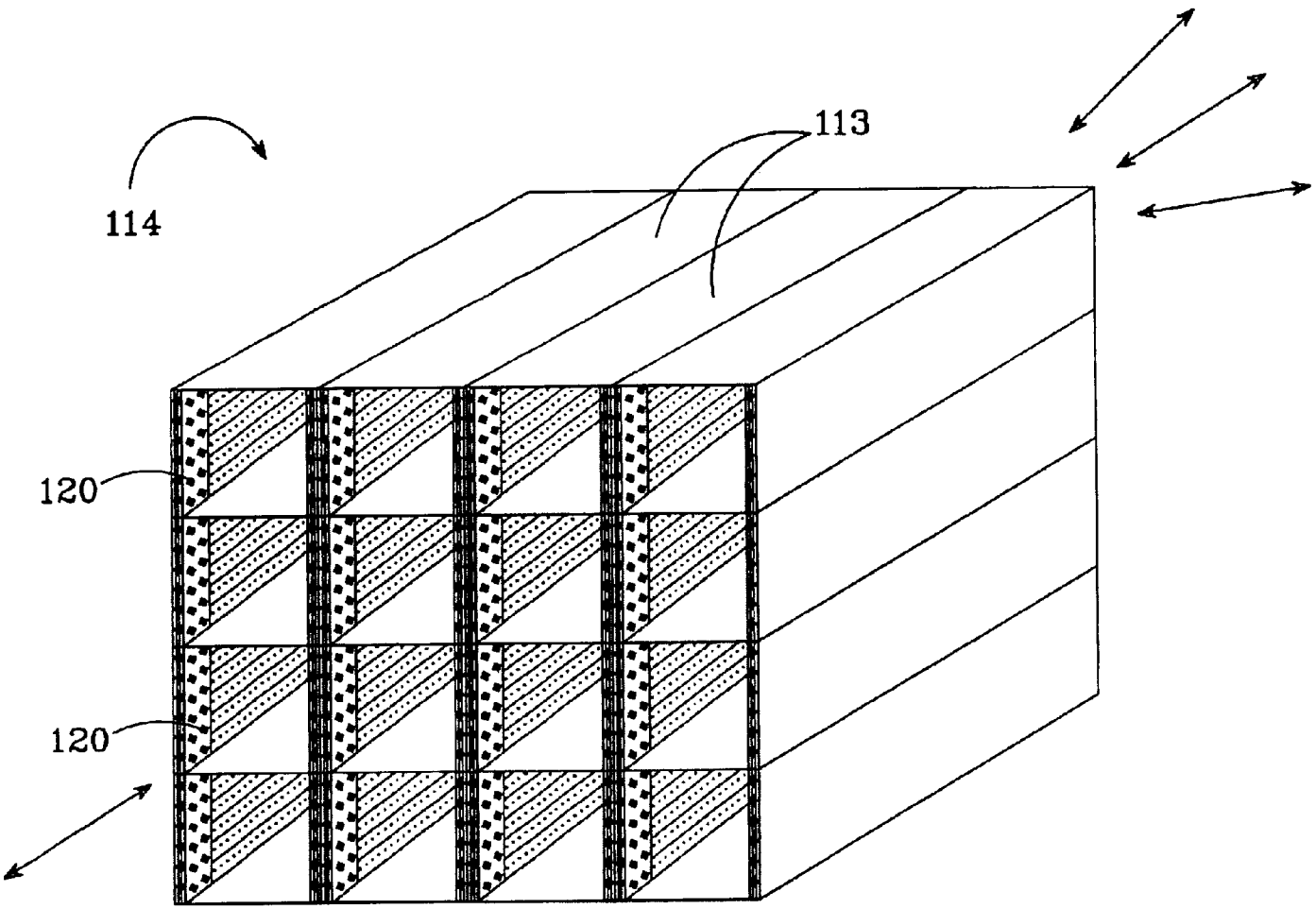
FIG. 11 is a perspective view of a module comprised of the new waveguides.

As shown in FIG. 11, individual waveguides 113 can be mounted adjacent to one another to form a rectangular wall module 114 resembling a honeycomb. The module 114 is placed in the path of a millimeter beam of a particular frequency, with a portion of the beam passing through most or all of the waveguides 113. The module shifts the beam's phase or steers the beam, and if desired amplifies the beam. The module 114 can have different cross-sections, depending upon the beam's cross-section and whether the entire beam is to be intercepted. For instance, additional waveguides can be included at the central portion of the top, bottom and sides to give the module 114 more of a circular cross-section.

The module 114 can be comprised of any of the above described waveguides. If waveguide 10 from FIG. 1 is used each of the module's waveguides 112 can only impart a single phase shift to its beam portion. If each portion of the beam passing through each of the modules waveguides 112 receives the same phase shift, the beam continues to propagate on the same line but its phase is shifted by passing through the module 114. Alternatively, the beam can be steered to a single desired angle by setting the waveguides to impart linearly progressive phase increments from waveguide to waveguide. To steer the beam to the left, the phase shifts of the beam portions in the respective waveguides are incrementally increased from the right to left waveguides, in each of the module's rows. To steer the beam down the phase shift is incrementally increased in along each column of the module's waveguides. The beam can also be steered off angle by combining the row and column incremental increases. To steer the beam down and to the left, the phase shifts are incrementally increased from right to left and from top to bottom.

Using waveguide 40 from FIG. 4, the module can cause a range of phase shifts in the beam. Applying the same voltage to the varactor diodes in each waveguide 113, causes a phase shift in the beam. Applying a different voltage to the waveguides will cause a different phase shift. The module can also steer the beam by applying different voltages to the varactor diodes in different waveguides. Each waveguide with a different voltage will apply a different phase shift. The module can steer the beam to different angles by selecting appropriate patterns of phase shifts among the module's waveguides.

If the waveguide 70 from FIG. 7 is used, the module can impart a variable beam phase shift, steer the beam, and also amplify the beam. Each waveguide 70 has its own array amplifier chip to amplify its portion of the signal. The amplified signals combine into an amplified beam as they are emitted from the module's waveguides.

Figure 12:
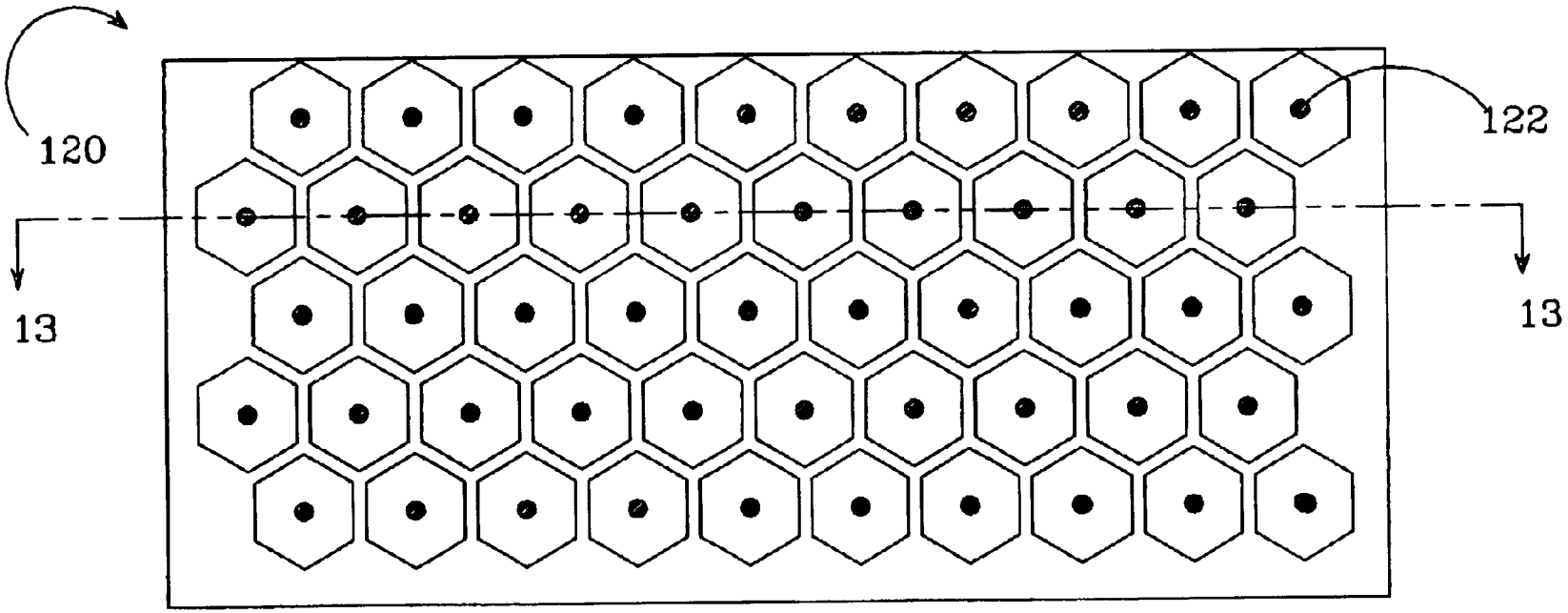
FIG. 12 is a plan view of the launching region used in each waveguide in the module shown in FIG. 11.
Figure 13:
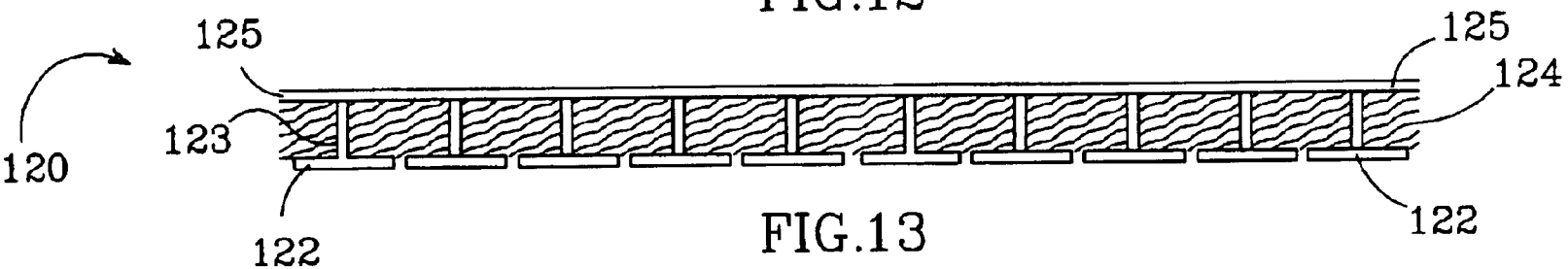
FIG. 13 is a sectional view of the launching region shown in FIG. 12, taken along section lines 13—13.

A portion of the incoming beam can reflect off the front edges of the waveguides 113, degrading the signal. To reduce this reflection, each of the waveguides can be provided with a launching region 120, beginning at the entrance to the waveguide 113 and continuing for a short distance down its length. FIGS. 12 and 13 show the launcher region 120 in more detail. It is similar to the above described strip impedance structures, but instead of strips which extend for the length of the waveguide, it employs an a array of mutually spaced conductive patches 122 on a dielectric substrate. The patches are preferably hexagonal shaped, but can also have other shapes. Vias 123 extend from the center of each patch 122, through the dielectric substrate 124 to a conductive layer 125 on the substrate's opposite side (as best seen in FIG. 13).

The launching regions resonate at the frequency of the beam entering the waveguides in the module. The vias which extend through the substrate present an inductive reactance (L), while the gaps between the patches present an approximately equal capacitive reactance (C) at the waveguides resonant frequency. The launching regions thus present parallel resonant high impedance L-C circuits to the beams E field component. The L-C circuits present an open-circuit to the E-field, allowing it to remain uniform across the waveguide. The low impedance on the top and bottom waveguide walls, which do not have impedance structures, allows current to flow and maintain a uniform H field.

The gaps between the patches 122 block surface current flow in all directions, preventing surface waves in the high impedance structures. This blocks TM and TE modes from entering the waveguide 112, admitting allowing TEM modes. Blocking the TM and TE modes reduces the front edge reflection with the front edge of the waveguide appearing nearly transparent to the beam at the resonant frequency.

The launching regions can be manufactured in a manner similar to the strip impedance structure. However, instead of etching the initially deposited conductive layer into strips, it is etched to form conductive patches.

Figure 14:
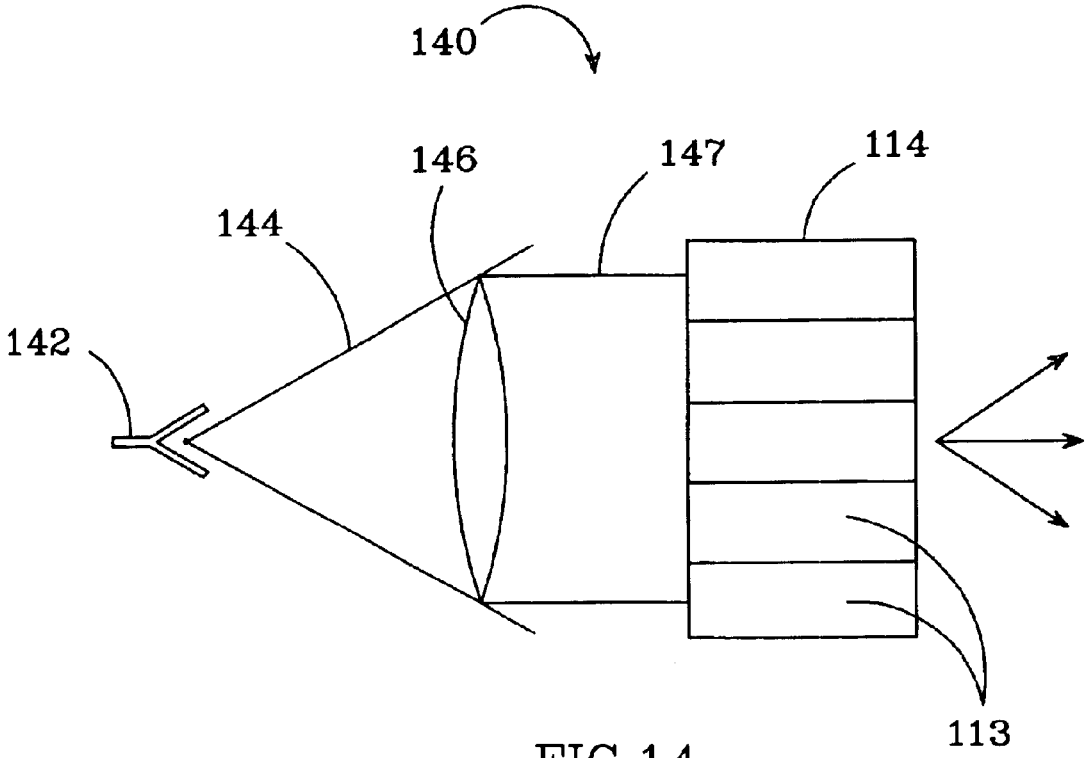
FIG. 14 is diagram of a millimeter beam transmission system using a module comprised of the new waveguides.

The module can be used in various millimeter wave applications. FIG. 14 shows a millimeter beam transmission system 140 used in various high frequency applications such as munitions guidance systems (e.g. seeker radar) A transmitter 142 generates a millimeter signal 144 that spreads as it moves from the transmitter. Most of the signal is directed toward a lens 146 that focuses the signal into a beam 147 with little diffraction. The module 114 is positioned in the beam's path with the longitudinal axis of the module's waveguides 113 aligned with the beam 147. Portions of the beam pass through at least some of the waveguides 113. To impart a uniform phase shift to the entire beam, the waveguides 113 shift the phase of their respective beam portions by equal amounts. The beam portions are emitted from their respective waveguides and combine to form a phase shifted beam.

To steer the beam, the waveguides 113 shift the phase of their respective beam portions by different amounts, as described above. Each of the waveguides 113 can also have amplifier arrays to amplify the beam 147.

Although the present invention has been described in considerable detail with reference to certain preferred configurations thereof, other versions are possible. For example, the phase shifting and steering module can have different impedance structures and the module can be used in other applications. Therefore, the spirit and the scope of the appended claims should not be limited to their preferred versions described herein or to the embodiments in the above detailed description.

I claim:

1. A rectangular waveguide for shifting the phase of a signal transmitted through the, waveguide, comprising:

a waveguide comprising a top wall, a bottom wall and two sidewalls; and at least one pair of opposing impedance wall structures, with one of said at least one pair being on said top wall and bottom wall, or said sidewalls, or both, each of said wall structures presenting an alterable surface impedance to transmitted signals of said waveguide, each of said wall structures presenting a high impedance to a resonant frequency signal transmitted by said waveguide, said surface impedance being alterable to cause the phase of said resonant frequency signal to change, wherein said wall structures present high impedance resonant L-C circuits to said resonant frequency signal, said impedance being alterable to present a primarily inductive impedance to said resonant frequency signal.

2. A rectangular waveguide for shifting the phase of a signal transmitted through the waveguide, comprising:

a waveguide comprising a top wall, a bottom wall and two sidewalls; and at least one pair of opposing impedance wall structures, with one of said at least one pair being on said top wall and bottom wall, or said sidewalls, or both, each of said wall structures presenting an alterable surface impedance to transmitted signals of said waveguide, each of said wall structures presenting a high impedance to a resonant frequency signal transmitted by said waveguide, said surface impedance being alterable to cause the phase of said resonant frequency signal to change, wherein each of said impedance wall structures comprises:

a substrate of dielectric material having two sides;

a conductive layer on one side of said dielectric material;

a plurality of mutually spaced conductive strips on the other side of said dielectric material, said strips separated by gaps and positioned parallel to said waveguide's longitudinal axis; and a plurality of conductive vias extending through said dielectric material between said conductive layer and said conductive strips; and a means for altering said impedance presented to said transmitted signals of said waveguide.

3. The waveguide of claim 2, wherein said conductive strips and said dielectric substrate present a capacitive impedance to said resonant frequency having an E field transverse to said conductive strips.

4. The waveguide of claim 2, wherein adjacent pairs of said strips present a capacitance and said dielectric substrate presents an inductance to said resonant frequency signal having an E field transverse to said conductive strips.

5. The waveguide of claim 4, wherein said conductive strips and dielectric substrate defines a series of L-C circuits to said resonant frequency signal having an E field transverse to said conductive strips.

* * * * *